US006233760B1

(12) United States Patent
Cavazos

(10) Patent No.: US 6,233,760 B1
(45) Date of Patent: May 22, 2001

(54) BOX SPRING WITH PADDED COVER

(76) Inventor: Frank G. Cavazos, 14040 Shoshoni Dr., Lockport, IL (US) 60441

( * ) Notice: Subject to any disclaimer, the term of this patent is extended or adjusted under 35 U.S.C. 154(b) by 0 days.

(21) Appl. No.: 09/363,753

(22) Filed: Jul. 30, 1999

(51) Int. Cl.[7] ..... A47C 23/00

(52) U.S. Cl. ..... 5/248; 5/246; 5/738; 5/922; 5/716

(58) Field of Search ..... 5/737, 738, 716, 5/248, 246, 922, 721, 717

(56) References Cited

U.S. PATENT DOCUMENTS

| | | | | |
|---|---|---|---|---|
| 2,159,535 | * | 5/1939 | Schulman | 5/717 |
| 3,837,020 | * | 9/1974 | Bosch | 5/922 |
| 3,967,331 | * | 7/1976 | Glassman | 5/246 |
| 4,100,631 | * | 7/1978 | Sloane | 5/246 |
| 5,701,653 | * | 12/1997 | Rupe | 5/400 |

* cited by examiner

*Primary Examiner*—Alexander Grosz
(74) *Attorney, Agent, or Firm*—Ernst Kettelson

(57) ABSTRACT

A box spring or other cushioning member for laying a mattress thereon which has a padded fabric cover over the upper wall and peripheral side walls to present a finished appearance and to provide protective padded surfaces for those handling such box springs or other cushioning members. The padded fabric cover is releasably secured to the box spring or other member, and it includes an upper fabric panel as well as a padded fabric peripheral side wall panel whose upper peripheral edge is sewn to the peripheral edge of the upper fabric panel. The padded fabric peripheral side wall panel extends outwardly and downwardly from the upper fabric panel and terminates in a free peripheral edge which overhangs the lower wall of the box spring or other member. The overhang portion is folded under the lower wall of the box spring or other member and releasably secured to the peripheral outer edge of the lower wall by respective cooperative fabric strips of releasably interconnecting hook and loop construction, one such strip on the inwardly facing surface of the overhang portion and the other of such strips around the facing portion of the peripheral edge of the lower wall of the box spring or other member.

17 Claims, 5 Drawing Sheets

BOX SPRING WITH PADDED COVER

FIELD OF THE INVENTION

This invention relates to the field of box springs for mattresses and other types of supporting members for mattresses. In particular it relates to a box spring or other mattress supporting member which has a releasably securable padded fabric cover to provide a finished fabric appearance and a protective padded surface over the top and sides of the box spring or other mattress supporting member.

BACKGROUND OF THE INVENTION

Relevant prior art of which the inventor is aware is set forth in the following patents discovered during his searches for prior art.

U.S. Pat. No. 5,214,809 discloses an articulated mattress for an adjustable bed which has hinge portions between mattress sections for limited pivotal movement of one section relative to another.

U.S. Pat. No. 5,040,255 discloses a cushion or mattress structure comprising a box structure with side, top and bottom walls of foam material, and cavity within the box to receive encased springs.

U.S. Pat. No. 4,956,884 discloses a modular box spring mattress comprising a plurality of plate sub units in which coil springs are received and held by flexible retaining arms. The sub units have cooperative coupling structures to hold adjacent sub units together.

U.S. Pat. No. 4,868,941 discloses an assembled mattress having an upper sheet with integrally formed sleeves or bellows extending downward and a lower sheet with integrally formed sleeves or bellows extending upward, with individual coil springs seated in each of the sleeves or bellows.

U.S. Pat. No. 2,547,840 discloses a sectional mattress comprising three separate sections positioned end to end, with one end of a coil spring connected at each end of the middle section and on both sides thereof, having the other end of each coil spring connected to the adjacent mattress section at each opposite end of the middle section.

U.S. Pat. No. 2,446,775 discloses an innerspring mattress construction made up of sections which are glued together along facing end walls to make up a completed mattress.

U.S. Pat. No. 2,249,266 discloses a combined chair and bed having a mattress like coil spring cushion supported on a hinged frame which folds down into a bed and angularly to form a chair in one position and a recliner in another.

U.S. Pat. No. 2,216,991 discloses three mattress units which are connected end to end to make a complete mattress. The units are connected by a transverse cylindrical bar insert on one unit which is received in a sleeve have a split cylindrical wall around its through passageway on the adjacent unit.

U.S. Pat. No. 1,915,674 discloses a coil spring assembly for making cushions, comprising four or more coils in a row connected by an elongated endless loop of twisted wire which includes one elongated strand connected to one side of each coil in the row and a second parallel strand connected to the opposite side of each coil in the row, such rows of coils in turn being connected to adjacent rows of coils by C-wires or fasteners known as hog rings.

U.S. Pat. No. 1,459,540 discloses a sectional mattress comprising three separate sections that are laid end to end to make up a complete mattress and can be interchanged in their relationship to each other. The innersprings within each section are encased in bags.

The inventor's own U.S. Pat. No. 5,435,026 discloses a do-it-yourself type of mattress which can be put together by the customer after purchasing the necessary component parts.

The inventor's own U.S. Pat. No. 5,471,688 discloses a modular innerspring assembly for a mattress and a modular box spring assembly on which the mattress is placed.

The inventor's own U.S. Pat. No. 5,485,639 discloses an S-shaped metal connecting clip having a spring characteristic to more easily connect the border wire around the top and bottom of an innerspring assembly to the top and bottom coils of adjacent coil springs.

The inventor's own U.S. Pat. No. 5,644,811 discloses a mattress having access to materials sandwiched between the mattress covers and the innerspring or other innercushioning member.

RELATED APPLICATIONS

The inventor herein is also the inventor in co-pending patent application Ser. No. 08/835,184 filed Apr. 7, 1997 now U.S. Pat. No. 5,970,547 for a Modular Mattress and Innerspring as well as a continuation thereof, application Ser. No. 09/302,883 filed Apr. 30, 1999 now U.S. Pat. No. 6,055,689 and Ser. No. 09/001,915 filed Dec. 31, 1997 now U.S. Pat. No. 6,088,859 for a Mattress Assembly With a Releasable Border Strip.

SUMMARY OF THE INVENTION

This invention provides an improvement over prior art box springs which are unsightly and have exposed surfaces in which exposed portions of the spring assemblies and frame members can injure those handling, demonstrating and using such prior art box springs. In accordance with the present invention, a protective fabric cover of padding material is provided to cover those exposed surfaces and to also provide a nicer finished appearance. The improvement is particularly significant for modular box springs and modular mattresses wherein purchasers can themselves replace originally purchased modules which have become soiled or worn. The protective fabric padded cover is releasably secured to the box spring assembly by respective cooperative strips of hook and loop construction as explained in more detail hereinbelow.

DESCRIPTION OF PREFERRED EMBODIMENT

Figure 1:
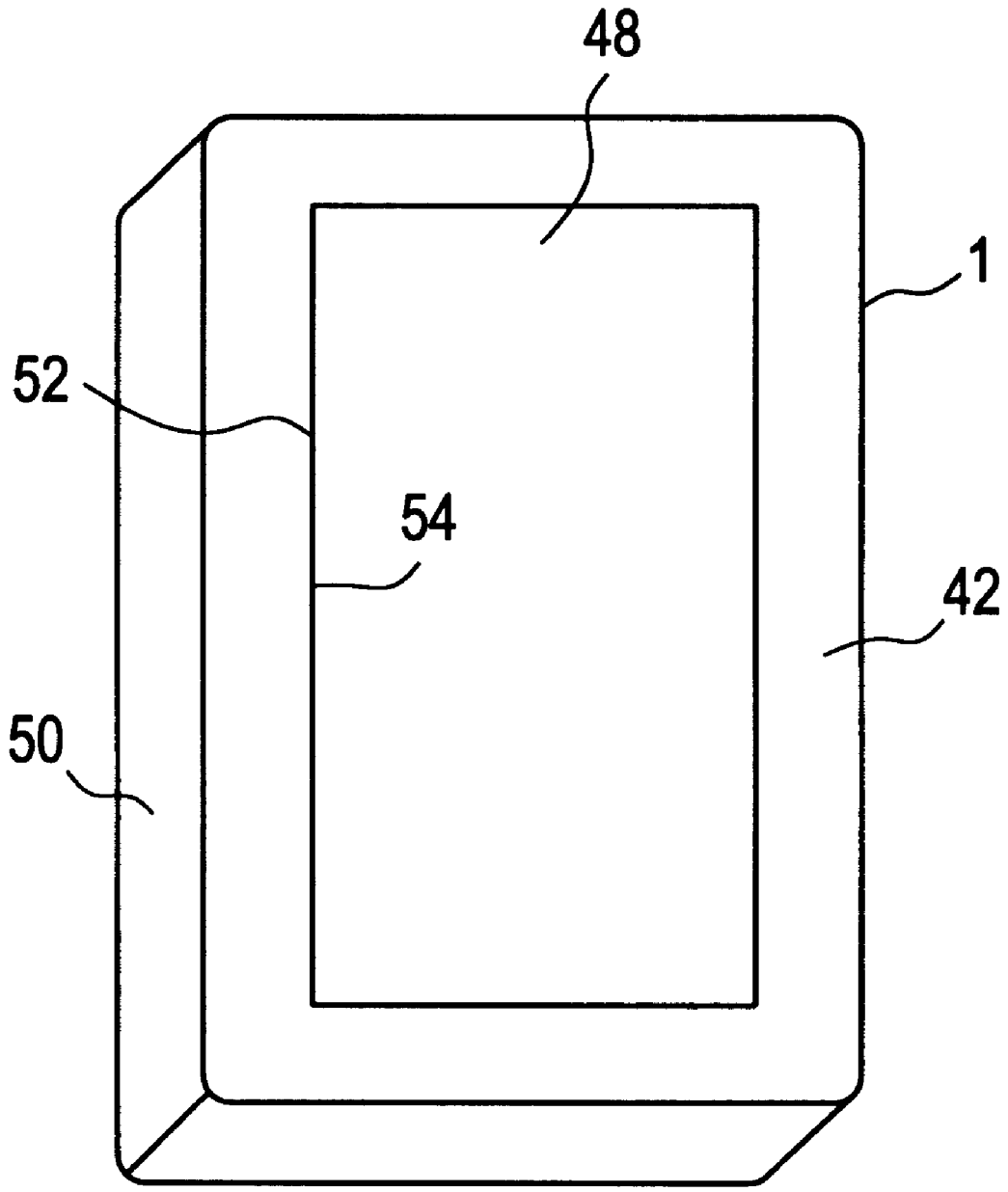
FIG. 1 is a perspective view of a box spring with a padded cover in accordance with his invention.
Figure 2:
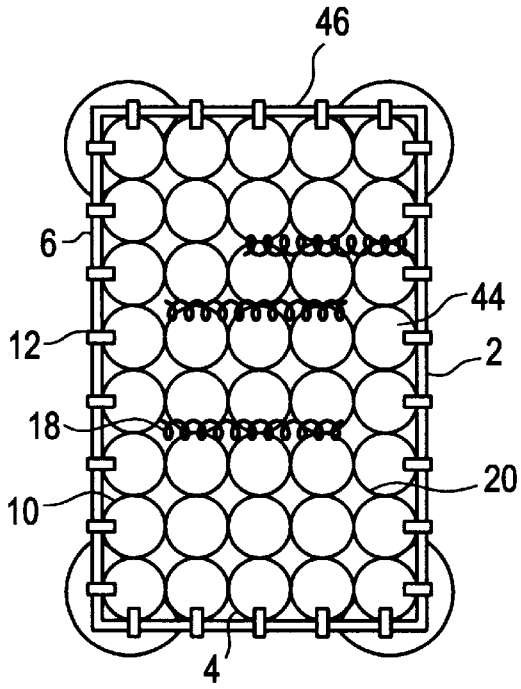
FIG. 2 is a top plan view of the box spring assembly portion of the invention with the padded cover removed.
Figure 3:
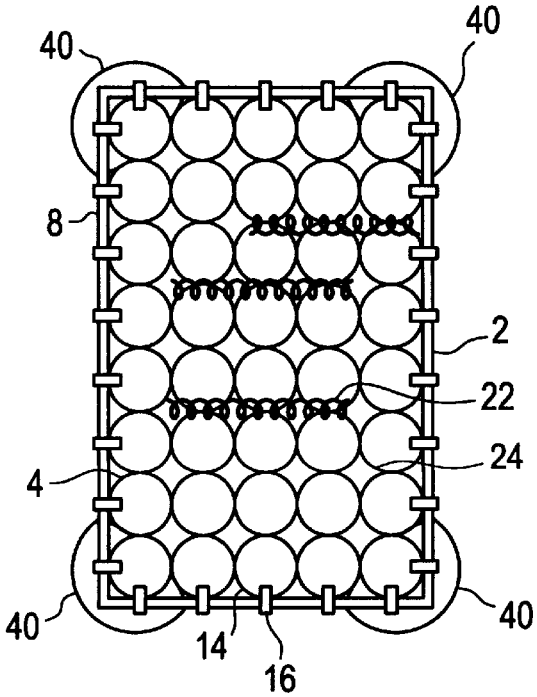
FIG. 3 is a bottom plan view of the box spring assembly but with its wooden base member removed to view the bottom portions of the springs and lower wire frame member.
Figure 4:
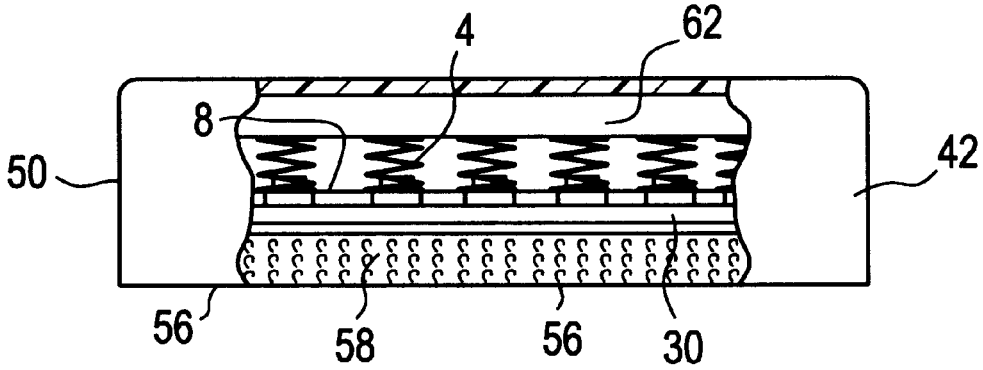
FIG. 4 is a side elevation view of the box spring with a padded cover in accordance with this invention, with a portion of the peripheral side wall of the cover cut away and partially in section to view a second top padded cover that goes under the outer padded cover and to show it in place on the box spring assembly; also the lower edge of the peripheral side wall of the outer padded cover is shown hanging loose with an overhang portion extending below the wooden base frame member which has a peripheral strip of cooperative fastening loop members therearound for interconnection with a corresponding peripheral strip of cooperative fastening hook members on the outwardly facing peripheral frame portion of the wooden base member when the overhang portion of the peripheral side wall of the outer padded cover is folded under the wooden base member and pressed thereagainst.
Figure 5:
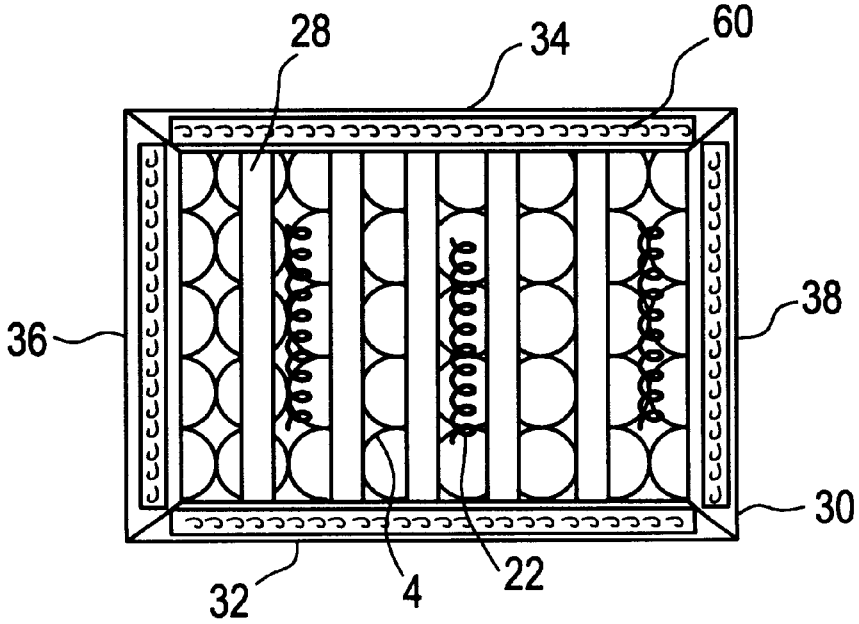
FIG. 5 is a bottom plan view of the box spring assembly showing the peripheral strips of cooperative fastening hook members on the outwardly facing peripheral frame portion of the wooden base member.
Figure 6:
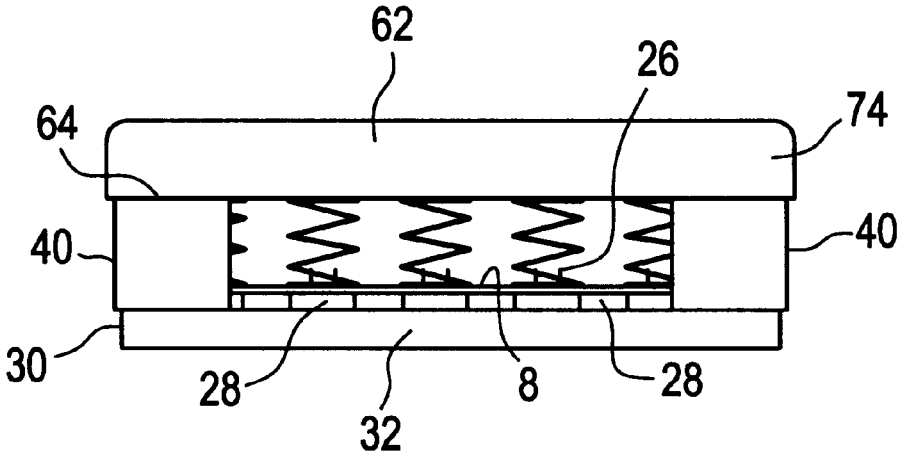
FIG. 6 is a side elevation view of the box spring assembly in accordance with this invention with the outer padded cover removed to illustrate the inner top padded cover in place on the box spring assembly.
Figure 7:
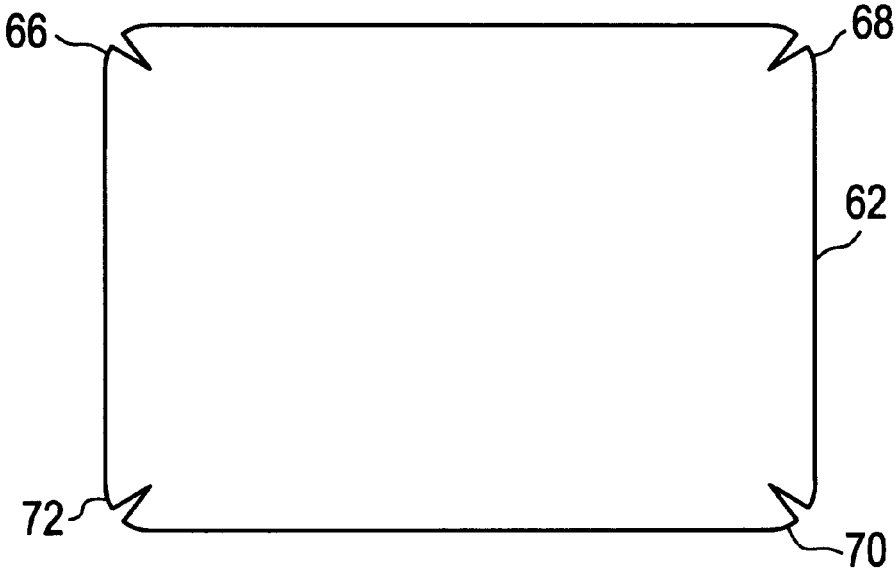
FIG. 7 is a top plan view of the inner top padded cover seen in FIG. 6.
Figure 8:
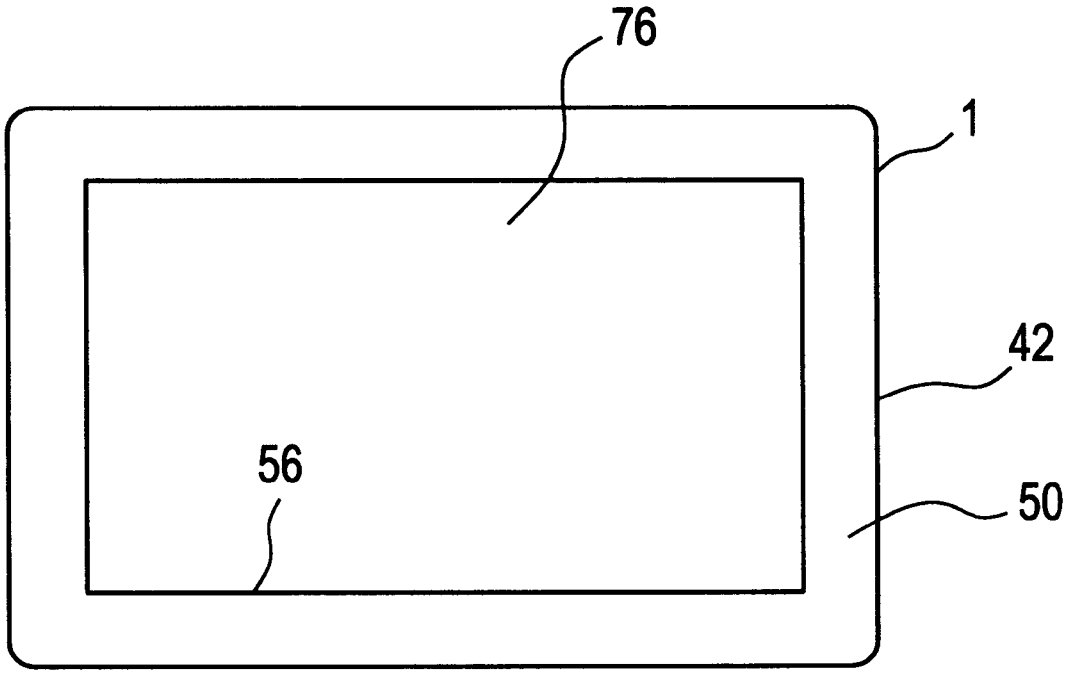
FIG. 8 is a bottom plan view of the invention to show the outer free edge of the peripheral side wall of the outer padded cover releasably secured in place against the underside of the wooden base member and to show the fabric sheet which covers the wooden base member.

A box spring with a padded cover 1 in accordance with the present invention comprises a box spring assembly 2 having a plurality of coil springs 4 held together by an upper peripheral wire frame member 6 extending around the upper periphery of the box spring assembly and a lower wire frame member 8 extending around the lower periphery thereof. The coil springs around the outer periphery of the box spring assembly are secured at their upper ends 10 to the upper peripheral wire frame member 6 by clips 12, and at their lower ends 14 to the lower peripheral wire frame member 8 by clips 16.

The coil springs 4 which are inward from the outer periphery are secured to adjacent coil springs by lengths of helically wound wire 18 which are intertwined around the uppermost turns 20 of adjacent coil springs 4 and by lengths of helically wound wire 22 intertwined around the lowermost turns 24 of adjacent coil springs 4.

The lower wire frame member 8 and lowermost turns 24 of coil springs 4 are secured by staples 26 to laterally extending spaced apart slats 28 of a wooden base frame 30. In addition to the spaced apart slats 28, the base frame 30 comprises a pair of spaced apart longitudinally extending wood strips 32 and 34 along the respective opposite longitudinal sides of the box spring assembly 2, connected at each opposite end to respective laterally extending and spaced apart wood strips 36 and 38.

Cushioning blocks 40 of compressive foam material are provided at each of the four corners of the box spring assembly 2 which project outwardly from the peripheral edge thereof to protect the fabric cover 42. That fabric cover extends over the upper surface 44 of the box spring assembly 2 as well as peripheral side walls 46 thereof.

The fabric cover 42 includes an upper fabric panel 48 to lay over the upper surface 44 of the box spring assembly and a peripheral fabric panel 50 having its upper peripheral edge 52 sewn to the peripheral edge 54 of the upper fabric panel 48. The peripheral fabric panel 50 is of a padded fabric material. The upper fabric panel 48 has a smaller peripheral dimension and cross-section, smaller both longitudinally and laterally, than that of the upper surface 44 of the box spring assembly 2. Thus, when the padded peripheral fabric panel 50 is sewn to the upper fabric panel 48 and laid over the upper surface 44 of the box spring assembly 2, an upper peripheral portion of the padded peripheral fabric panel 50 extends over the peripheral edge of the box spring assembly 2 to provide cushioning for such peripheral edge. The padded peripheral fabric panel 50 has a longitudinal dimension sufficient to extend around the peripheral side and end walls of the box spring assembly 2. It has a lateral dimension greater than the corresponding side and end wall dimension of the box spring assembly 2 between its upper and lower peripheral wire frame members, sufficiently greater to extend from the peripheral edge of the upper fabric panel 48 out to the upper peripheral edge of the box spring assembly 2 then down along the side and end walls thereof to terminate in a peripheral lower edge 56 which extends below the wooden base frame 30 about two to three inches.

A continuous strip of a first cooperative fabric fastener 58 having tiny loops is sewn to the inner surface of the padded fabric panel 50 extending inward thereof from its peripheral lower edge 56. A continuous strip of a second cooperative fabric fastener 60 having tiny hooks is stapled or otherwise secured to the outwardly facing surface of the longitudinally extending wood strips 32 and 34 and laterally extending wood strips 36 and 38 of the wooden base frame 30.

The fabric cover 42 is releasably secured to the box spring assembly 2 by placing the upper fabric panel 48 over the upper surface 44 of the box spring assembly 2 and extending the padded peripheral fabric panel 50 outwardly over the upper peripheral edge of the box spring assembly 2 and downwardly along its side and end walls. The overhand portion of the padded peripheral fabric panel 50 inward from its lower peripheral edge 56 is then folded inwardly under the lower peripheral edge of the box spring assembly 2 to place the strip of said first cooperative fabric fastener 58 having tiny loops sewn to the inner surface thereof in facing and fastening relationship with the strip of said cooperative fabric fastener 60 having tiny hooks secured to the wood strips of the wooden base frame 30. When pressed together, the continuous strips of the first and second cooperative fabric fasteners inter-connect and releasably secure the padded fabric cover 42 to the box spring assembly 2.

Before the fabric cover 42 is placed on the box spring assembly 2, a padded top cover 62 is placed over the upper surface 44 of the box spring assembly. The padded top cover 62 comprises a padded panel of cushioning fabric material having a peripheral dimension greater than that of the upper surface 44 of the box spring assembly 2, including a longitudinal and lateral dimension greater than that of the upper surface 44, by about three or four inches, whereby the outer peripheral edge 64 of the padded top cover extends outwardly about three or four inches from the upper peripheral edge of the box spring assembly 2. This overhand portion is folded downwardly, its corners 66, 68, 70 and 72 tucked inwardly and each respective tuck is sewn together, thereby forming a downwardly extending short side wall 74 around the periphery of the padded top cover 62 to extend downwardly a short distance along the peripheral side and end walls of the box spring assembly 2 when put in place thereon. The fabric cover 42 is then placed over the padded top cover 62 and the box spring assembly 2 and releasably secured thereto as described above.

A bottom fabric sheet 76 covers the lower surface of the wooden base frame 30.

The box spring assembly having a padded cover in accordance with the present invention is particularly adapted for modular box springs wherein several relatively small box spring units may be laid side by side to make up a completed box spring of whatever dimension desired. The invention is also readily adapted for a single box spring for use with any size mattress.

The upper fabric panel 48 and the padded peripheral fabric panel 50 include an outwardly facing surface of finished fabric to present an attractive finished product appearance when the fabric cover 42 is releasably secured in ace on the box spring assembly 2. The box spring assembly 2 in accordance with this invention is preferably square or rectangular in its peripheral configuration although other configurations are not excluded.

I claim:

1. A unitary, integrally connected box spring having a padded cover, comprising a box spring assembly having an upper wall, an oppositely facing lower wall and a peripheral side wall extending therearound, a supporting frame for said box spring extending upwardly from said lower wall, said supporting frame having an upwardly facing connecting surface, a cushioning assembly extending upwardly from said supporting frame and in direct facing relationship thereto, said cushioning assembly being integrally secured to said upwardly facing connecting surface of said supporting frame, and padding means for covering wall portions of said box spring assembly.

2. A unitary, integrally connected box spring having a padded cover as set forth in claim 1, wherein said padding means is releasably secured to said box spring assembly.

3. A unitary, integrally connected box spring having a padded cover as set forth in claim 1, wherein said padding means includes a fabric cover.

4. A unitary, integrally connected box spring having a padded cover as set forth in claim 3, wherein said fabric cover includes an upper panel for placing over a portion of said upper wall of said box spring assembly and a padded fabric peripheral panel for placing over said peripheral side wall of said box spring assembly.

5. A unitary, integrally connected box spring having a padded cover as set forth in claim 4, wherein said upper panel of said fabric cover has a smaller longitudinal dimension than said upper wall of said box spring assembly.

6. A unitary, integrally connected box spring having a padded cover as set forth in claim 5, wherein said upper panel of said fabric cover has a smaller lateral dimension than said upper wall of said box spring assembly.

7. A unitary, integrally connected box spring having a padded cover (42) as set forth in claim 6, wherein said padded fabric peripheral panel (50) of said fabric cover (42) is secured to the peripheral edge (54) of said upper panel (52), said padded fabric peripheral panel (50) has a greater dimension in the direction between said upper wall (44) and said lower wall (30) of said box spring assembly (2) than the dimension between said upper wall (44) and said lower wall (30) of said box spring assembly (2).

8. A unitary, integrally connected box spring having a padded cover as set forth in claim 7, wherein said padded fabric peripheral panel extends outwardly and downwardly from said upper panel of said fabric cover to terminate in a peripheral free edge, said peripheral free edge extending beyond said lower wall of said box spring assembly when said fabric cover is in place on said box spring assembly to provide an overhang portion, said overhang portion of said padded fabric peripheral panel having an inwardly facing surface, first cooperative releasable securing means on said inwardly facing surface for releasably securing said fabric cover to said box spring assembly, said lower wall of said box spring assembly including second cooperative releasable securing means located thereon for releasable interconnection with said first cooperative releasable securing means of said inwardly facing surface of said overhang portion of said padded fabric peripheral panel when said overhand portion is folded inwardly to extend over and face a peripheral edge portion of said lower wall of said box spring assembly.

9. A unitary, integrally connected box spring having a padded cover as set forth in claim 8, wherein one of said first and second cooperative releasable securing means includes a first fabric strip having tiny loops thereon and the other includes a second fabric strip having tiny hooks thereon for releasable interconnection with said tiny loops of said first fabric strip when pressed together.

10. A unitary, integrally connected box spring having a padded cover as set forth in claim 7, wherein said padded fabric peripheral panel includes an outwardly facing surface of finished fabric.

11. A unitary, integrally connected box spring having a padded cover as set forth in claim 3, wherein said padding means includes a separate top cover of padding material to place over said upper wall of said box spring assembly before said fabric cover is put thereon.

12. A unitary, integrally connected box spring having a padded cover as set forth in claim 1, wherein said supporting frame includes a wooden base member.

13. A unitary, integrally connected box spring having a padded cover as set forth in claim 12, wherein said wooden base member includes a pair of spaced apart longitudinal side wood strips along respective ones of the opposite side edges of said box spring assembly, a pair of spaced apart lateral end wood strips along respective ones of the opposite end edges of said box spring assembly, and a plurality of additional spaced apart laterally extending wood strips between said pair of spaced apart lateral end wood strips.

14. A unitary, integrally connected box spring having a padded cover as set forth in claim 13, wherein said cushioning assembly includes a plurality of coil springs.

15. A box spring having a padded cover comprising a box spring assembly having an upper wall, an oppositely facing lower wall and a peripheral side wall extending therearound and padding means for covering wall portions of said box spring assembly, wherein said padding means includes a separate top cover of padding material to place over said upper wall of said box spring assembly before said fabric cover is put thereon, wherein said padding means includes a fabric cover, wherein said top cover includes a panel of padding material having a longitudinal and lateral dimension greater than that of said upper wall of said box spring assembly to provide a peripheral overhang portion of said top cover, said peripheral overhang portion being folded downwardly to face a portion of said peripheral side wall of said box spring assembly when said top cover is in place on said upper wall of said box spring assembly.

16. A box spring having a padded cover as set forth in claim 15, wherein said box spring assembly is rectangular in peripheral configuration and said top cover is rectangular in configuration having four corners, each of said corners of said top cover are tucked inwardly to form a tuck at each said four corners when said peripheral overhang portion is folded downwardly, each of said tucks being sewed together thereby forming a top cover having an upwardly facing panel with a short integrally formed peripheral side wall.

17. A unitary, integrally connected cushioning box member for a mattress having a padded cover, comprising a cushioning assembly having an upper wall over which a mattress is to be placed, an oppositely facing lower wall and a peripheral side wall extending therearound and padding means for covering wall portions of said cushioning assembly, a supporting frame for said cushioning assembly extending upwardly from said lower wall, said supporting frame having an upwardly facing connecting surface, said cushioning assembly being fixedly secured directly to said upwardly facing connecting surface of said supporting frame.

* * * * *